US010722748B1

(12) United States Patent
Acosta et al.

(10) Patent No.: US 10,722,748 B1
(45) Date of Patent: Jul. 28, 2020

(54) LUNG, DIAPHRAGM AND SURROUNDING AREAS OF THE ANATOMY INSTRUMENT TRAINING DEVICE AND METHOD

(71) Applicant: Lung Trainers, LLC, Miami, FL (US)

(72) Inventors: Frank Acosta, Miami, FL (US); William Rose, Miami, FL (US)

(73) Assignee: Lung Trainers, LLC, Miami, FL (US)

( * ) Notice: Subject to any disclaimer, the term of this patent is extended or adjusted under 35 U.S.C. 154(b) by 75 days.

(21) Appl. No.: 15/934,646

(22) Filed: Mar. 23, 2018

(51) Int. Cl.

| | |
|---|---|
| ***A63B 23/18*** | (2006.01) |
| ***A63B 21/008*** | (2006.01) |
| ***A63B 21/00*** | (2006.01) |
| ***A63B 21/06*** | (2006.01) |
| *G04F 5/02* | (2006.01) |

(52) U.S. Cl.
CPC ..... *A63B 23/18* (2013.01); *A63B 21/00065* (2013.01); *A63B 21/0085* (2013.01); *A63B 21/06* (2013.01); *G04F 5/02* (2013.01)

(58) Field of Classification Search
CPC ..... A63B 21/00065; A63B 21/0085; A63B 21/06; A63B 23/18
See application file for complete search history.

(56) References Cited

U.S. PATENT DOCUMENTS

| | | | | |
|---|---|---|---|---|
| 4,391,283 | A * | 7/1983 | Sharpless | A61B 5/0875 482/13 |
| 6,723,024 | B2 * | 4/2004 | Levine | A63B 23/185 482/13 |
| 9,180,340 | B2 * | 11/2015 | Hsieh | A63B 21/0085 |
| 9,561,399 | B2 * | 2/2017 | Acosta | A63B 23/18 |
| 10,086,230 | B2 * | 10/2018 | Acosta | A63B 23/18 |
| 10,213,565 | B2 * | 2/2019 | Potter | A61M 16/0488 |
| 2005/0165322 | A1 * | 7/2005 | Bryant | A61B 5/0875 600/538 |
| 2015/0283352 | A1 * | 10/2015 | Karkkainen | A61M 16/16 128/203.26 |

* cited by examiner

*Primary Examiner* — Megan Anderson
(74) *Attorney, Agent, or Firm* — Peter A. Koziol, Esq.; Assouline & Berlowe, P.A.

(57) ABSTRACT

A lung, diaphragm and surrounding muscles/areas of the anatomy instrument training device using a regulator including at least one weighted insert, a hollow chamber having a bottom and a top, wherein the weighted insert is positioned within the hollow chamber, and a tube, wherein the distal end of the tube is connected to the hollow chamber, and a user breathes into the proximal end of the tube. A method for exercising diaphragm and lung capacity, strength and control including exhaling air from a user's lung in a tube connected to a chamber, moving at least one weighted insert positioned inside the chamber; and regulating the position of one or more weighted inserts within the chamber.

17 Claims, 6 Drawing Sheets

LUNG, DIAPHRAGM AND SURROUNDING AREAS OF THE ANATOMY INSTRUMENT TRAINING DEVICE AND METHOD

CROSS-REFERENCE TO RELATED APPLICATIONS

This invention is an improvement upon U.S. patent application Ser. No. 14/697,779 to Acosta, Frank titled Lung Instrument Training Device and Method filed Apr. 28, 2015.

FIELD OF THE INVENTION

The invention broadly relates to lung exercises, more specifically to a device to strengthen lungs, the diaphragm, surrounding muscles/areas of the anatomy and increase lung control and capacity, and even more particularly to a method to strengthen lungs, diaphragms, and surrounding muscles/areas of the anatomy and increase lung control and capacity.

BACKGROUND OF THE INVENTION

Wind instruments are musical instruments that typically include some type of resonator. A column of air is vibrated by a user blowing air into or over a mouthpiece located at the end of a resonator. The pitch of the vibration is determined by the length of the tube in conjunction with modifications of the effective length of the vibrating column of air. In a similar way, vocalists use air to produce pitches. Examples of common wind instruments include horns, trumpets, recorders, flutes, and saxophones.

Musicians playing wind instruments or vocalists require high levels of lung capacity and lung, diaphragm and surrounding muscles/areas of the anatomy control to hit the applicable notes and note lengths while playing a composition. Each wind instrument or voice requires different levels of air regulation and exhaling. Plus, musical compositions vary in difficulty, thereby increasing the lung demand on the musician playing the instrument.

A musician must have the lung, diaphragm, and surrounding muscles/areas of the anatomy control and capacity to breath sufficient air into the instrument to properly play or sing the musical notes and timing required in the musical composition. Although there are a myriad of exercise equipment to exercise a person's muscles or increase their cardiovascular stamina, there has been a need to develop a device and method to increase a person's lung, diaphragm and surrounding muscles/areas of the anatomy strength and capacity.

Often, a new student, without training, can only play certain wind instruments for a limited period of time before they run out of air, i.e. they become "winded." The more the student plays the instrument over time, the student's lung capacity and strength increases due to the training. However, this takes a long time to occur as the training only occurs as the student practices with the instrument. The size of some wind instruments makes playing frequent playing difficult. Also, some environments do not allow students to practice frequently due to the loud noise emanating from the wind instrument.

There are some devices in the market that develop air capacity for users. However, these devices do not have a system to train a person's lung, diaphragm and surrounding muscles/areas of the anatomy by regulating weight suspended in air. Moreover, existing devices do not mimic musical instruments for training purposes.

As such, there is a need for a lung, diaphragm and surrounding muscles/areas of the anatomy control and capacity training device and method that changes based on the user's needs. As the user learns to use an instrument or voice and advances to a more complex level, the user needs to increase the user's lung capacity, strength and control. The training requires a calculated system to increase a user's lung capacity, strength and control based on current and future needs.

As can be derived from the variety of devices and methods directed at increasing lung, diaphragm and surrounding muscles/areas of the anatomy strength, capacity and control, many means have been contemplated to accomplish the desired end, i.e., training a user's lungs. Thus, there is a long-felt need for a device and method to aid a user in increasing their lung capacity, strength and control.

The inventors identified herein have created such a device as described in U.S. patent application Ser. No. 14/697,779 incorporated herein by reference in its entirety. That invention provides an elegant device and method of using weighted inserts to measure and control lung, diaphragm and surrounding muscles/areas of the anatomy strength training. However, said invention has been further improved in the manner in which the weights can be changed, which it can be cleaned, its ability to regulate airflow, and in its use in classrooms and competitive environments as described herein.

BRIEF SUMMARY OF THE INVENTION

The present invention broadly includes at least one weighted insert, a hollow chamber having a bottom and a top, where the weighted insert is positioned within the hollow chamber. The present invention also includes a tube, where the distal end of the tube is connected to the bottom of the hollow chamber and a user breathes into the proximal end of the tube. The invention makes use of set screw, timer, and contacts to control the timer and prevent the weighted inserts from sticking to the resting stop.

In a further embodiment, the present invention includes a mouthpiece for a user to breathe into that is connected to the proximal end of the tube.

In yet a further embodiment, the present invention includes an anti-bacterial coating on the inner surface of the breathing tube.

In an additional embodiment, the present invention includes a timer to track the time of engagement by a user exercising with the lung instrument training device. The timer may be mounted on a stand or the chamber and is optionally capable of being connectively attached to leads, triggers or sensors that detect movement, and engagement of the inserts and/or air pressure in the chamber.

It is a general object of the present invention to provide a method for exercising lung capacity by exhaling air from a user's lung in a tube connected to a chamber, moving at least one weighted insert positioned inside the chamber, and regulating the position of the weighted inserts within the chamber.

The invention provides mechanisms for airflow control and regulation and an improved method for modifying the weighted inserts.

The invention is improved by addition of a brass ring. A purpose of the brass ring is to prevent the stainless steel inserts from being forced out of the chamber. An adjustable screw (set screw) has been inserted into the brass ring so that the user can take the inserts out as necessary.

Magnets have been added to the back of the device. This enables the device to be used on a metal music stand or other metal surface determined by the user. Variation in size of the magnets use is dependent on the strength needed to adhere to the attaching surface.

Additional sizes of the back panel have been added to the device allowing the device to be: 1) permanently placed on the wall; 2) placed on a metal object by use of magnets; or 3) placed on a metal or similar substance for use on a flat surface. Preferred mount sizes include 12"×12", 9"×12", 8×12" and 9"×9", but other sizes are contemplated. Current variations of the chamber on the back panel are diamond and rectangular placement, but other shapes and configurations are contemplated and desired depending on the application.

Additions of 1" and 1½" stainless steel inserts have been added to the weighted system to allow the user to control the air pressure needed to move the weights up through the chamber. Other sizes, materials and weights are contemplated. Stainless steel is a preferred material because of amongst other things, its durability, and anticorrosive properties.

An embodiment includes a small approximately 2-3 millimeter hole (outlet) that has been placed perpendicular or opposite to the front of the chamber. Once inserts have been moved above the hole, air is release requiring constant pressure exerted by the user to maintain suspension of the weighted inserts. The released air reinforces that a users' lung, diaphragm and surrounding muscles/areas of the anatomy consistently be utilized throughout the exercises. Based upon the current size of inserts the hole is preferred at approximately 3 inches from the base and its size may vary based upon the desired required airflow. Zero to multiple holes may be used.

A further improvement is that a tube with 1, 2, 3 or more holes has been inserted in to the air tube to allow the user to control the volume of air used to move the weighted inserts. This change makes the device easier to be utilized by varied groups (e.g. athletes, yoga enthusiasts, medical patients, etc.).

A counter/timer (digital computer) has been placed on the back panel. The counter can be controlled by the user and the user feedback on their progress. The computer provides timed measurements, including counts of breaths, air pressure, duration of exercise, and intervals of rest, etc. It is placed so that it may be viewed by the user, instructor and/or both during the exercises.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawings.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "breathing" is synonymous with terms such as "exhaling", "inhaling", "blowing", "gasping", "puffing", etc., and such terms may be used interchangeably as appearing in the specification and claims. Although any methods, devices or materials similar or equivalent to those described herein can be used in the practice or testing of the invention, the preferred methods, devices, and materials are now described.

Exercising a user's lungs improves a user's breathing capacity and control. As with swimming and marathon athletes, training improves oxygen intake and the cardiovascular system. The present invention is preferably used for persons seeking to improve breathing technique and capacity. However, the lung, diaphragm and surrounding muscles/areas of the anatomy instrument training device provides support in numerous fields, including but not limited to, athletics, music, yoga, and medicine. The present invention also promotes greater lung control and strength.

Figure 1:
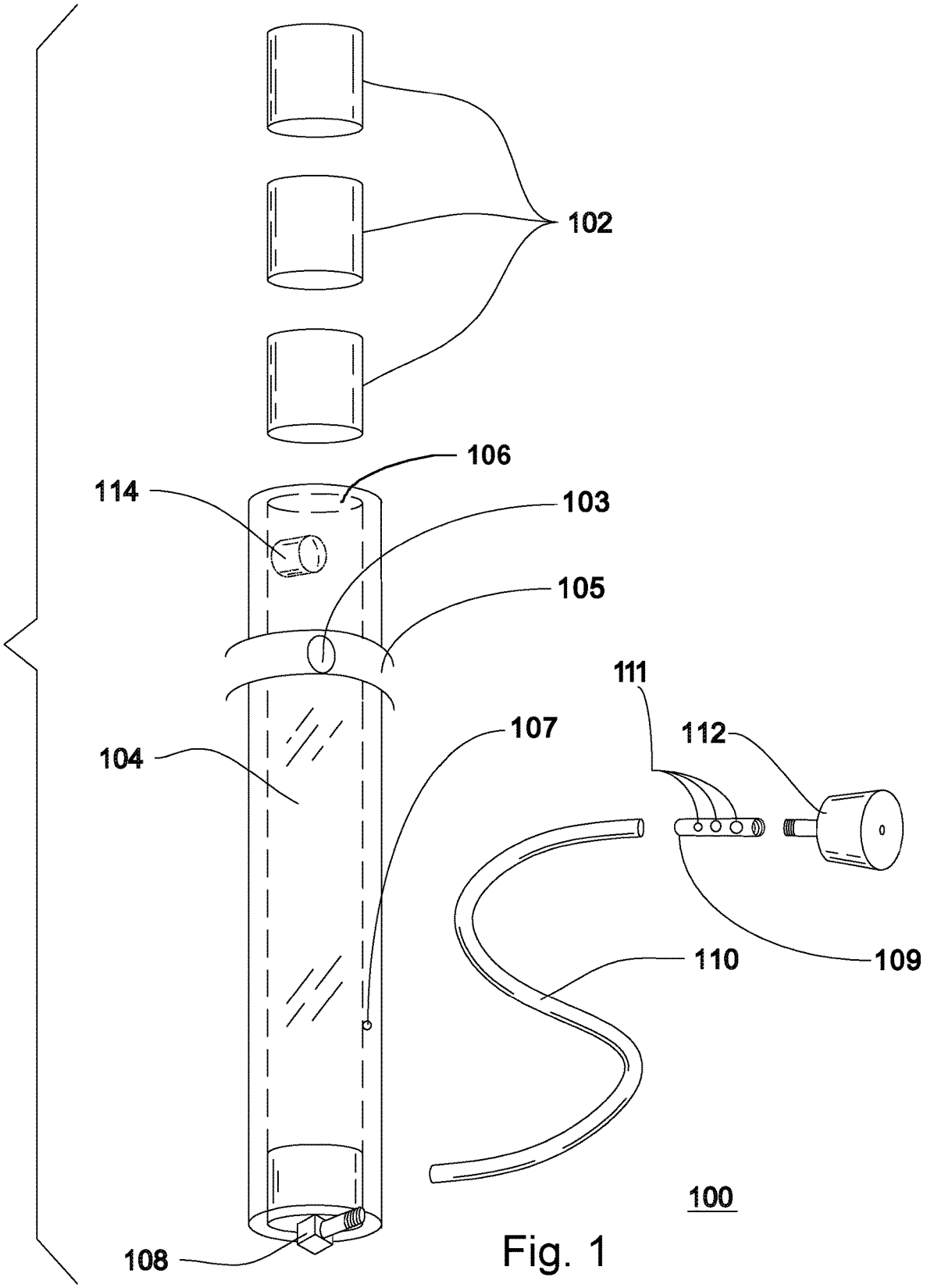
FIG. 1 is an exploded view of the lung instrument training device.
Figure 2:
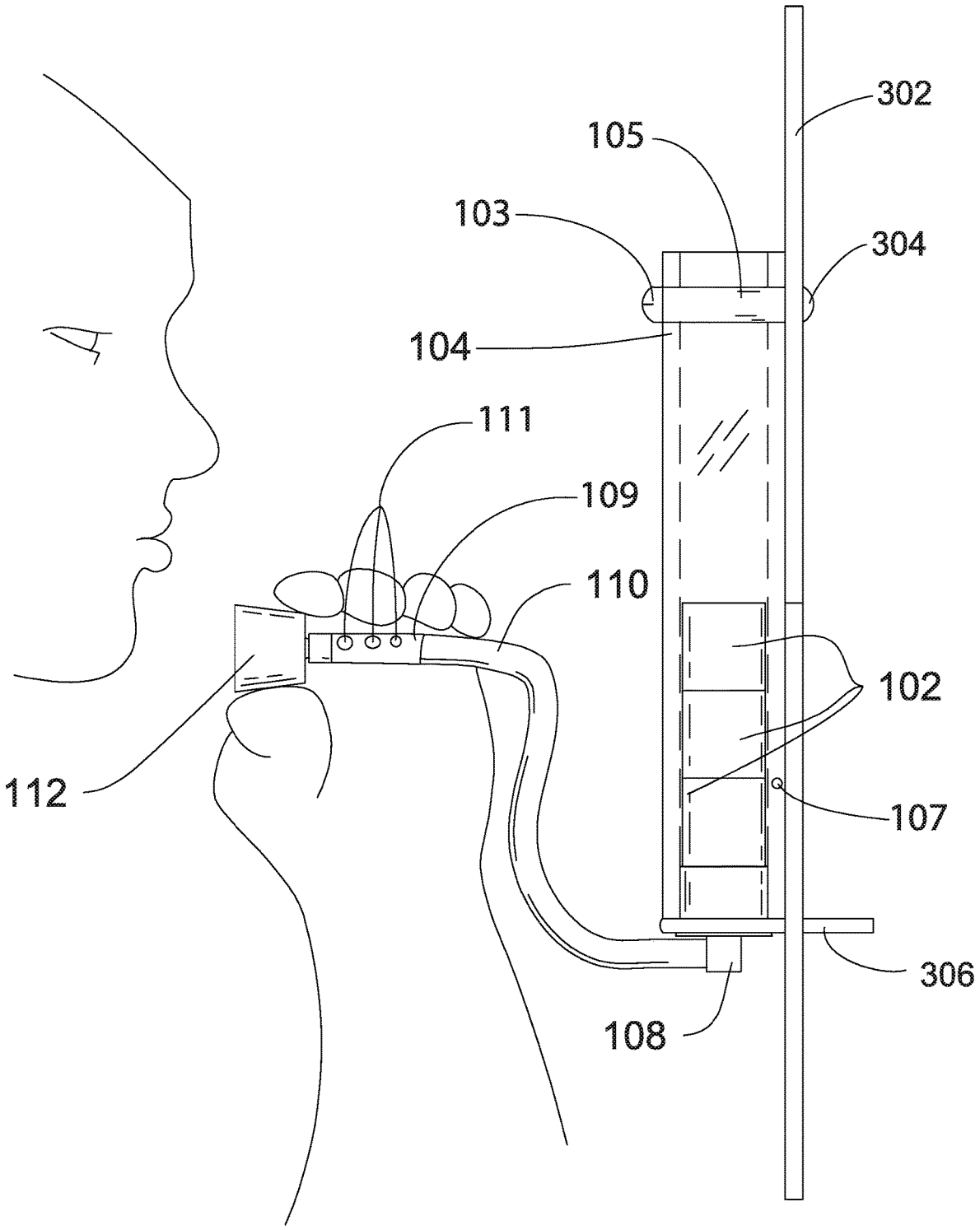
FIG. 2 is a front cut-out view of the weighted inserts inside the chamber of the present invention.

Adverting now to the Figs., FIGS. 1 and 2 illustrate a lung instrument training device 100 for a user to exercise their lungs. FIG. 1 illustrates three weighted inserts 102 enclosed within chamber 104. The chamber may be any shaped chamber as long as the weights are able to move freely within the chamber while blocking or substantially restricting the airflow. Weighted inserts 102 are preferably made of non-oxidized material, such as copper or stainless steel. However, any material may be used for weighted inserts 102 in the present invention. Chamber 104 is preferably made from plastic or acrylic. Preferably, the material is translucent so the user can view the inside chamber of chamber 104.

Chamber 104 has a hollow center in which weighted inserts 102 are inserted through chamber opening 106 at the top of chamber 104. As shown in FIG. 1, the bottom portion of chamber 104 is enclosed. Tube connector 108, located underneath the enclosed bottom of chamber 104, connects to the distal end of tube 110. Tube connector 108 is preferably a stainless steel L connector use to connect chamber 104 to tube 110. However, any appropriate connector made of any suitable material may be used. The proximal end of tube 110 connects to regulator 109 which connects to mouthpiece 112.

To use the lung instrument training device 100, a user places mouthpiece 112 to the user's mouth. The user then exhales, or blows air, from the user's lungs into mouthpiece 112. Depending on the training program selected, a user chooses to take a deep breath prior to engaging mouthpiece 112 to the user's mouth. The air exhaled from the user's lungs enters mouthpiece 112, travels through tube 110, and enters tube connector 108.

The air then flows from tube connector 108 into chamber 104, filling the internal chamber of chamber 104 exerting pressure on weighted inserts 102. As the user increases the force of air exhaled into mouthpiece 112, the force exerted onto weighted inserts 102 increases. When the force of the air within chamber 104 exceeds the weight of weighted inserts 102, the weighted inserts 102 move along the length of chamber 104. If enough air is exhaled into mouthpiece 112, weighted inserts 102 travel through chamber 104 and stop at weight stop 114 or set screw 103. The weighted stop may preferably be a set screw, cotter pin or other stop adjustable from the front of the device. Weighted inserts 102 travel through chamber 104 due to the radial gap between the weighted inserts 102 and chamber 104.

Figure 4:
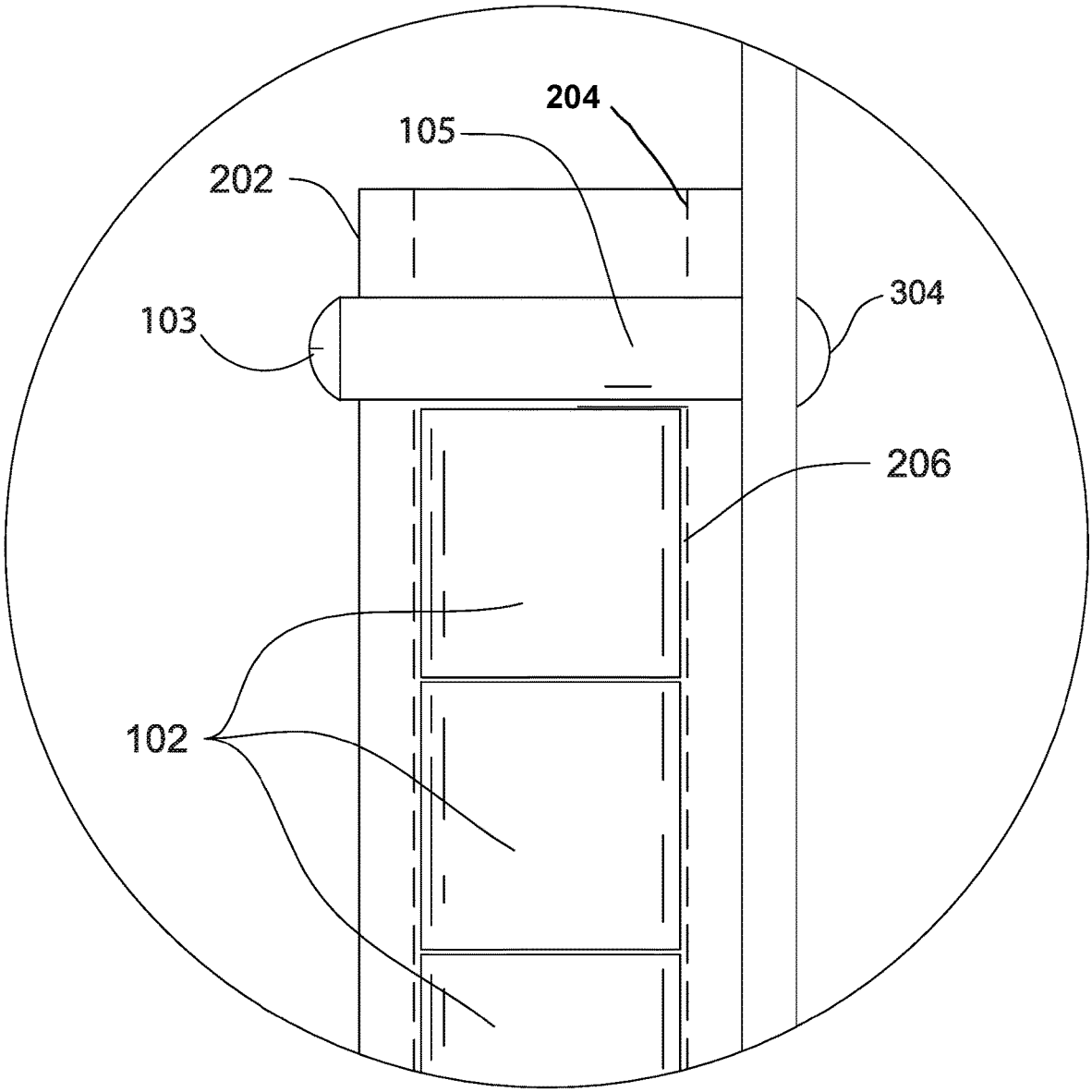
FIG. 4 is a side view of a user exhaling into the present invention while the weighted inserts are at the maximum travel position inside the chamber.

As shown FIG. 4, chamber 104 includes outer chamber surface 202 and inner chamber surface 204. The diameter of weighted inserts 102 is smaller than the inside diameter of inner chamber surface 204. The distance between the diameter of weighted inserts 102 and the inner chamber surface 202 is defined as air gap 206. This air gap is minimized, however, if the gap is insufficient, friction prevents the inserts 102 from moving. Air gap 206 provides the spacing needed to allow weight inserts 102 to travel through chamber 104 as air enters and fills chamber 104.

The objective of the present invention is for a user to regulate the air being exhaled from his lungs, into mouthpiece 112, to suspend weighted inserts 102 within chamber 104. The user regulates the exhaling of air from his mouth into lung instrument training device 100 to regulate the travel of weighted inserts 102 within chamber 104.

Figure 3:
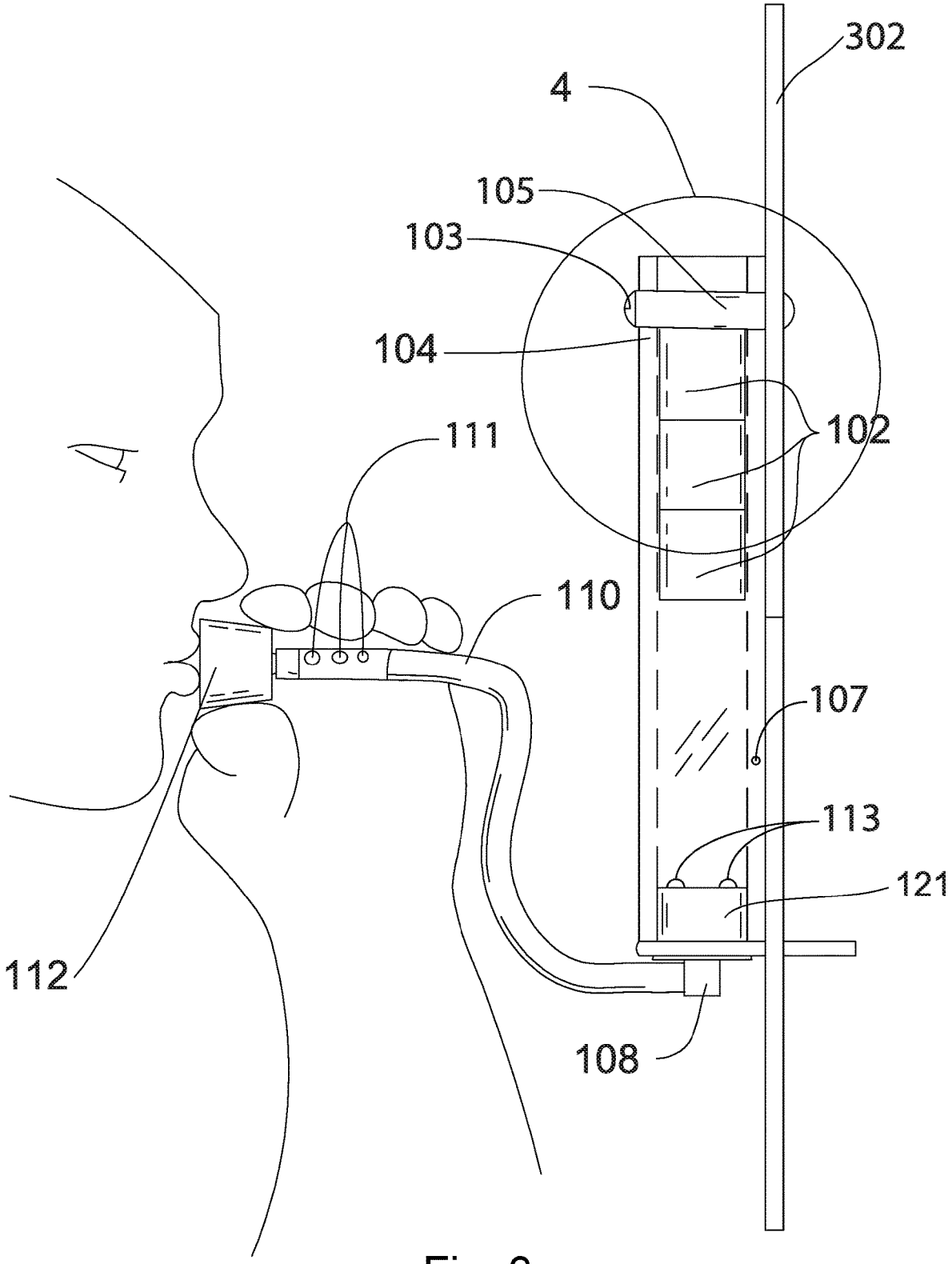
FIG. 3 is a side view of a user preparing to exhale into the present invention while the weighted inserts are at rest.

As shown in FIG. 3, weighted inserts 102 remain at the bottom of chamber 104, enclosed within the interior of chamber 104 when the device is disengaged. As the user exhales into lung instrument training device 100 with sufficient force, weighted inserts 102 travel within chamber 104. Although the travel of weighted inserts preferably occurs in the vertical position, an alternative embodiment allows the user to optimally vary the angle of operation of lung instrument training device 100.

The airflow required by the invention may be further varied by one or more holes 107, regulators or valves placed on the chamber 104 and one or more holes 111, regulators or valves 109 inserted into the tubing 110. By enabling air to escape the chamber and or tubing these holes, regulators and/or valves enable the user and or instructor to regulate the airflow required to lift maintain the suspension of the one or more weights. In the drawings the regulators are depicted as three holes of varying size, but they may take any form that enable the airflow to be adjusted. The air regulator provides independent control of air flow from air pressure; air pressure being controlled by the number of weighted inserts, air flow by the holes on the regulator. There may be a singular hole or regulator or multiple holes or multiple regulators.

The present invention is designed to train a user's lungs to increase lung capacity by regulating the amount of air a user exhales, i.e. breathes, into the device, to suspend weighted inserts 102 within chamber 104. It is advantageous to place the set screw, stopper, bolt, latch, hinge, switch, perforated stop or other adjustable obstruction toward the front of the device perpendicular to the user as it enables easier access and adjustment of the weights. The set screw or other stopper should be adjustable to enable the weights to be removed.

Figure 5:
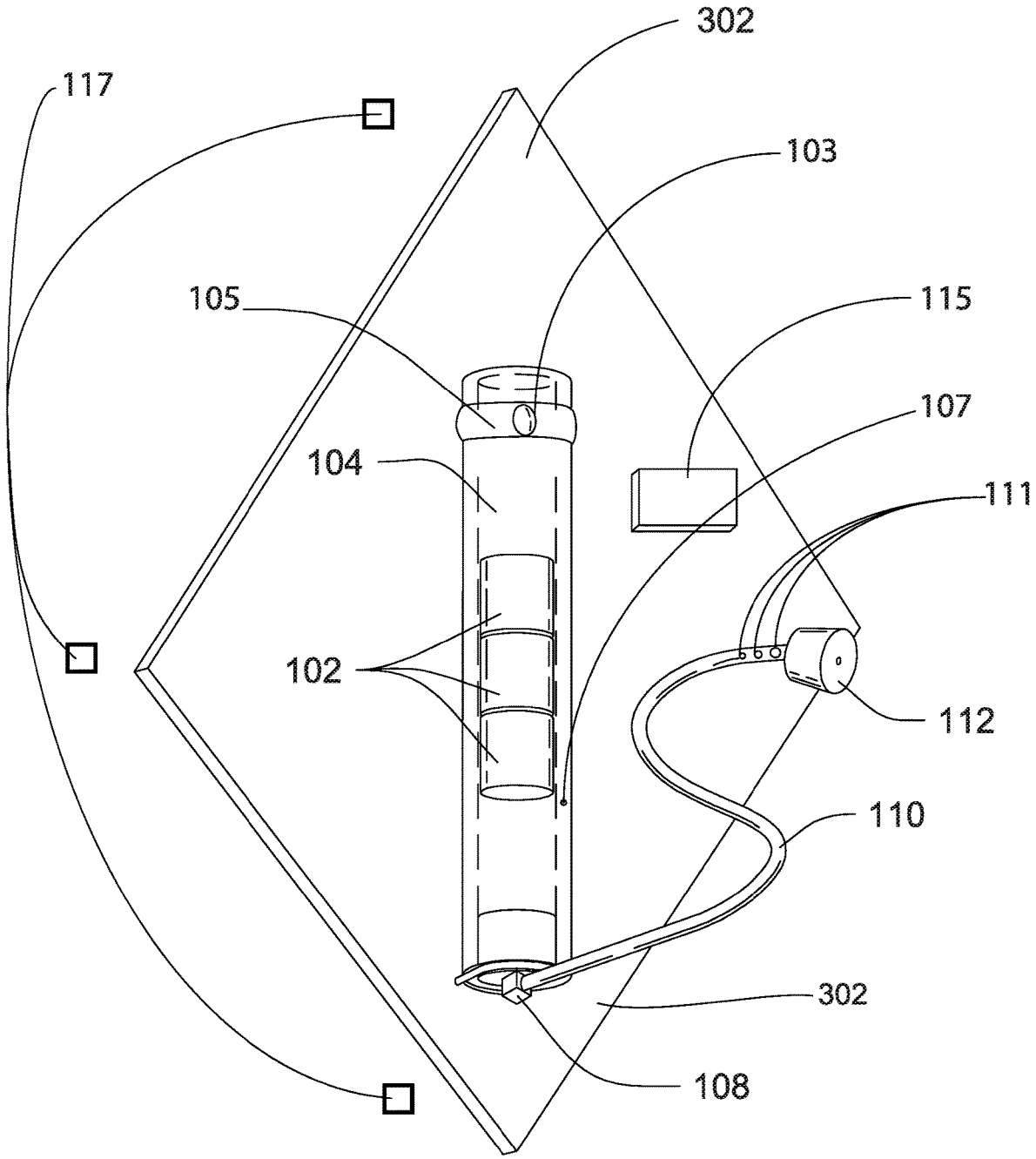
FIG. 5 is a perspective view of the present invention where the weighted inserts are suspended in air within the chamber due to user regulation of airflow.
Figure 6:
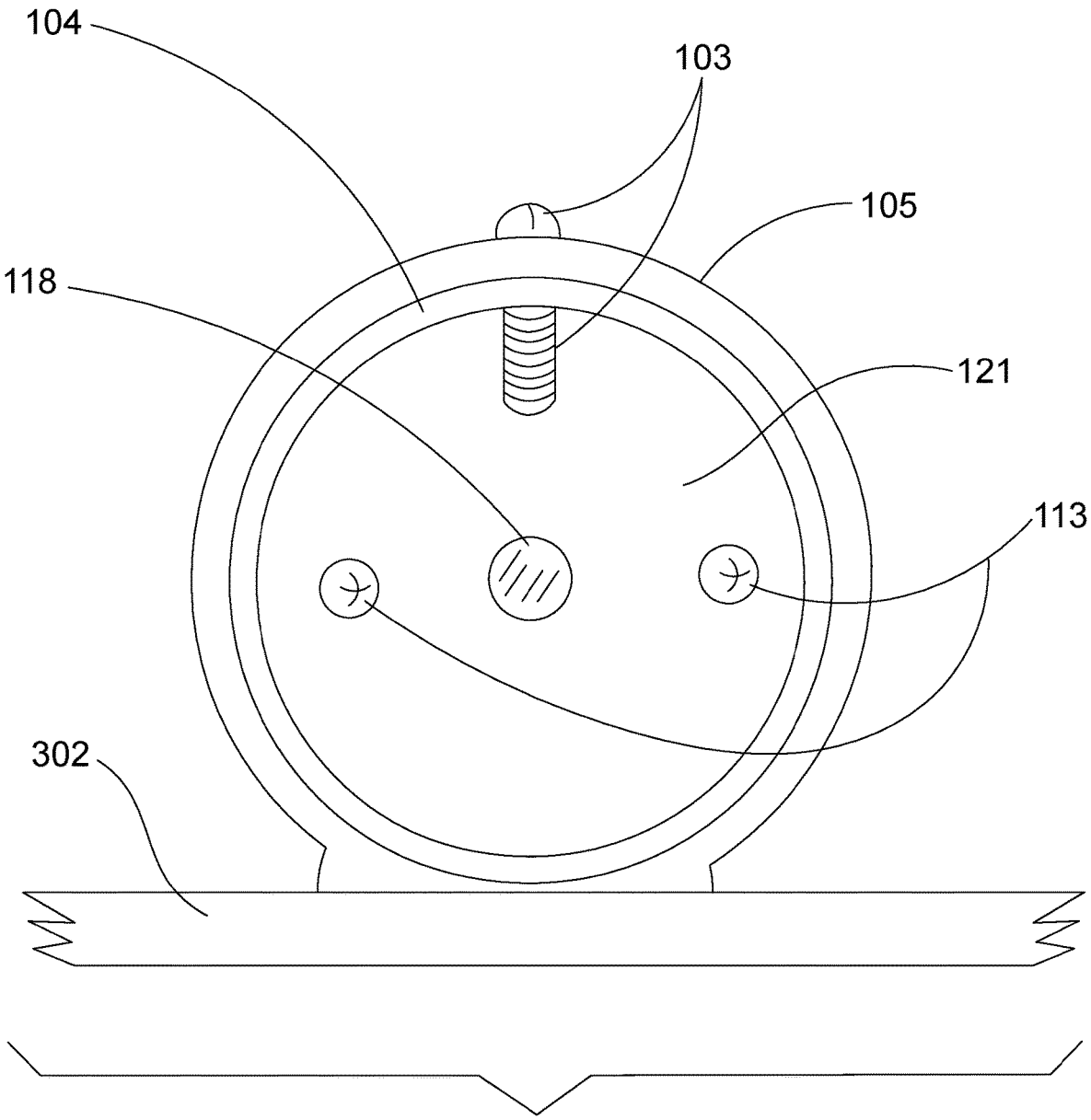
FIG. 6 is a top down view of the chamber with the weighted inserts removed showing the set screw/stop and contacts and chamber air inlet.

Regulation of the air the user breathes into mouthpiece 112 preferably keeps weighted inserts 102 suspended within chamber 104. FIG. 5 illustrates a user regulating the airflow and pressure the user breathes into the present device to keep the weighted inserts 102 suspended within chamber 104. The user increases the air flow output to move the weighted inserts 102 higher within the chamber 104. Conversely, the user decreases the airflow and pressure output to move the weighted inserts 102 lower within the chamber 104. In the context of the present invention, airflow output is the amount of air a user constantly exhales from his lungs into the mouthpiece 112, tube 110, or other entry point of the present device.

One of the many uses of the present invention is to aid musicians that must exhale air from their lungs into a musical instrument, such as but not limited to a tuba, saxophone, and recorder. A new user learning a musical instrument or voice needs to train his lungs to increase his lung capacity. This aids the student in playing complex or singing musical musician compositions.

As with any type of training, practice is required. First, the user must establish a baseline. For example, a new student's lung capacity requires only one weighted insert 102 to properly regulate the weighted insert 102 in a suspended position within chamber 104. As the student uses the present invention with one weighted insert 102, his lung capacity increases. This training is similar to muscle training to increase muscle strength for athletes and weightlifters.

For the user to increase lung, diaphragm and surrounding muscles/areas of the anatomy strength and/or capacity, a second weighted insert is added to the chamber 104 of the present invention. The user then attempts to regulate the two weighted inserts 102 in a suspended position within chamber 104. After practicing with the second weighted insert 102 added, the user's lung, diaphragm and surrounding muscles/areas of the anatomy strength and capacity increase. Additional weighted inserts 102 are added based on the specific needs of the user. The length of chamber 104 varies based on the height and number of weighed inserts 102 used.

Maintaining the appropriate regulation of airflow output by the student into the input of the present invention exercises the user's lungs. The user who started with diaphragm strength and lung capacity to play a recorder, after training with the present invention, can now play an instrument that requires more lung capacity and breathing regulation.

As with any training program, the number of weighted inserts 102 and the weight themselves are variable based on the needs of the user. Medical patients, such as those recovering from surgery or cancer rehabilitative treatments, will use the present invention to improve their lung, diaphragm and surrounding muscles/areas of the anatomy capacity and strength. The ability to adjust the number of weighted inserts and weight of the present invention provides a variable solution to improve a user's lung capacity, strength and control.

In an exemplary embodiment, mouthpiece 112 is connected to the proximal end of tube 110. Mouthpiece 112 provides a smooth fit to the user's mouth when exhaling air from his lungs into the present invention. Although mouthpiece 112 is made from numerous materials, the preferred composition of mouthpiece 112 is rubber, plastic, silicone, or copper, or stainless steel. The mouthpiece 112 is a universally shaped cylinder with a small aperture but may also be shaped to mimic the mouthpieces of various musical instruments to better assist musicians training to use a particular instrument. The mouth piece may be made of various materials including but not limited to silicone, glass, plastic, stainless steel, brass and/or copper.

In yet another exemplary embodiment, the weighted inserts are formed in the following shapes: cylinder, sphere, discus or cube. The present invention also includes a timer to keep track of the amount of time the user is actively regulating his airflow to keep weighted inserts 102 suspended. Moreover, instead or in addition to a timer, a metronome may be used for users to train regulating the weighted inserts 102 in a suspended state. A musician will use the counts of the metronome to know how many musical counts they can keep the weighted inserts 102 in a suspended state. This provides a measureable data point of how long the musician can hold various musical notes. The display for the timer and or metronome are preferably mounted on the mounting plate or otherwise incorporated into the device so that the user may view or listen to them as they use the device Sensors, contacts 113 and triggers in the device activate the timer, counter and/or metronome. Additional feedback may be provided by pressure sensors and/or gauges. In an example embodiment, one or more contacts at the base of the chamber complete or break a circuit to engage and disengage the timer, metronome, pressure sensor, and/or computerized and/or analog display. The placement of raised contacts 113 or a rough surface at the bottom of the chamber where the weighted inserts contact the stopper rest 121 helps to prevent the inserts from becoming stuck against the stopper rest 121, but the contacts may also be used to complete a circuit for the counter, timer, metronome, sensor, probe, or integrated computer. The stopper rest 121 is preferred to be made of rubber, or silicone, but be made of any material. Using a soft material reduces noise when the weighted inserts contact the stopper rest 121.

In a group context, users of the present invention engage in competition to determine which user suspends weighted inserts 102 the longest by regulating the user's breathing into the mouthpiece 112. This use of the present invention promotes a competition that facilitates training the user's lung capacity. To maintain a sterile environment, mouthpiece 112 is disengaged with tube 110 and changed for each user using the present invention.

A variety of users benefit from increasing lung capacity, strength and control using the present invention. Medical patients use the present invention to recover from surgery, traumatic injuries to their bodies, from diseases that diminish a person's lung, diaphragm and surrounding muscles/areas of the anatomy. Instead of merely exhaling or inhaling with a high force to test lung capacity, the present invention regulates the user's breathing using training programs to increase lung capacity. Moreover, athletes, such as swimmers and long distance runners, use the present invention to increase their lung capacity, strength and control for athletic events.

Another exemplary embodiment includes attaching the chamber 104 of the present invention to mounting plate 302, as shown in FIGS. 3, 4, and 5. A user holds the present invention substantially vertically in use. However, to use the present invention more effectively, chamber 104 is secured to mounting plate 302 using top connector 304 and bottom connector 306. Mounting plate 302 is optionally fastened to a wall in optimal position for the user to breathe into the present invention and view the weighted inserts 102. In another embodiment, mounting plate 302 is part of a carrying case that, when opened, turns into a stand. This allows a user to carry the present invention with them and use it a variety of environments without directly attaching the present invention to a wall, door, or other surface. It has been discovered that it is desirable to have magnets 117 on the back surface of the mounting plate to enable the device to be attached to metal such as those used in music stands. The magnets or similar attachment systems may be of varying strengths, sizes, shapes and configurations and are a preferred means of attaching device so that it is strongly attached and removable.

Bottom connection 306 is a U shaped fastening device with bolts that connect the chamber 104 to the mounting plate 302. Similarly, top connection 114 may be a screw that travels through mounting plate 302 and chamber 104, U shaped fastening device, ring 105, bracket and or other fastener that attaches the chamber to the mounting plate or other surface. A nylon or silicone sleeve located within chamber 104 secures the screw, thereby connecting mounting plate 302 to chamber 104. The use of a nylon, silicone, or similar sleeve provides a stopping point for the weighted inserts 102, similar to stopper 114 or set screw 103.

In another exemplary embodiment, the inner surface of tube 110, and corresponding connections, are lined with an anti-bacterial coating. Silver and copper are preferred anti-bacterial coatings. During prolonged use, the air passing through tube 110 includes saliva and bacteria from the user's mouth. These substances, when left to sit over time, breed bacteria that may cause disease or sickness to the user. Use of an anti-bacterial coating maintains a sterile environment for use by one or more users.

The present invention also includes a method for improving lung capacity. A user selects the number of weighted inserts 102 to begin using the present invention and places them in chamber 104. The user places his mouth onto a mouthpiece 112 of the invention 100. The user exhales, expressing air from his lungs into mouthpiece 112, through tube 110 and tube connection 108, and into chamber 104. Next, the force of the exhaled air from the user moves the weighted inserts 102 that are located inside of chamber 104. The user then regulates the user's airflow into the mouthpiece 112 to keep inserted weights 102 suspended within chamber 104. The user may adjust the airflow required to maintain suspension of the weighted inserts by adjusting the outlet 107, regulator 109 or valves. When multiple holes 111 are used to regulate the device the user may cover one or more of the different sized holes to alter the airflow like a flute or recorder. Once the user is unable to continue regulating his airflow, the user disengages his mouth from mouthpiece 112, thereby causing weighted inserts 102 to rest at the bottom of chamber 104.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. A device, comprising:

one or more inserts selected from a set comprising more than one insert;

a hollow chamber, wherein said one or more inserts are positioned within said hollow chamber;

a stop to prevent said one or more inserts from exiting the hollow chamber;

a tube, wherein said tube is connected to said hollow chamber;

at least one inlet to said hollow chamber to allow air from said tube to enter said hollow chamber;

at least one regulator in said tube; and, at least one outlet to allow air entering the device to escape.

2. The device recited in claim 1, where there is one or more contacts between the at least one inlet in the chamber and one or more of the one or more inserts.

3. The device recited in claim 2, where said one or more contacts are connectively associated with a timer.

4. The device recited in claim 2, where said one or more contacts are connectively associated with an electronic display.

5. The device recited in claim 2, where said one or more contacts are connectively associated with a sensor.

6. The device recited in claim 2, where said one or more contacts complete a circuit connected to an electronic display.

7. The device recited in claim 2, where said one or more contacts interrupt a circuit connected to an electronic display.

8. The device recited in claim 1, where the at least one outlet is located in the hollow chamber.

9. The device in claim 8 where said at least one outlet is directed in a direction between perpendicular and facing a mounting plate to parallel to said mounting plate.

10. The device recited in claim 1, where said stop is adjustable.

11. The device recited in claim 1, where said stop is removable.

12. The device recited in claim 1, where the at least one outlet is located on the tube and one or more additional outlets are located in the chamber.

13. The device recited in claim 1, where there is one or more contacts between the at least one inlet in the chamber and one or more of the one or more inserts.

14. The device recited in claim 1, where the at least one regulator located in the tube is rigid.

15. A method for exercising comprising:

exhaling air from a user's lung in a tube connected to a chamber;

regulating airflow of said chamber with at least one outlet;

regulating air pressure of said chamber with one or more inserts selected from a set comprising more than one insert and the user's diaphragm and surrounding muscles/areas of the anatomy;

where the exercise is timed by a timer that is triggered by displacement from one or more contacts within the chamber by the one or more inserts selected from the set comprising more than one insert.

16. The method recited in claim 15, further comprising placing the user's mouth onto a mouthpiece connected to said tube.

17. The method recited in claim 15 wherein insertion and removal of one or more inserts are alternately permitted and limited through turning one or more set screws.

* * * * *